US005960995A

United States Patent [19]

Leatherman et al.

[11] Patent Number: 5,960,995

[45] Date of Patent: Oct. 5, 1999

[54] ADJUSTABLE AND COLLAPSIBLE DRIP COLLECTION DEVICE

[76] Inventors: Sandra Ann Leatherman; Franklin Leatherman, both of 16206 Skye Ct.; Sheri Lynne Selzer; Wayne David Selzer, both of 1118B W. Washington St., all of Hagerstown, Md. 21740

[21] Appl. No.: 08/963,706

[22] Filed: Nov. 4, 1997

[51] Int. Cl.[6] ..... B67D 1/16

[52] U.S. Cl. ..... 222/108; 141/86; 141/88; 137/313

[58] Field of Search ..... 222/108; 141/86, 141/87, 88; 137/313

[56] References Cited

U.S. PATENT DOCUMENTS

| | | | |
|---|---|---|---|
| 163,481 | 5/1875 | Gray | 222/108 |
| 215,016 | 5/1879 | Mettee | 222/108 |
| D. 326,795 | 6/1992 | Reitz et al. | D7/397 |
| 555,820 | 3/1896 | Kaup | 137/313 X |
| 1,108,692 | 8/1914 | Burd | 108/97 |
| 1,256,206 | 2/1918 | Cordley | 222/108 |
| 1,660,074 | 1/1928 | Hagg | 222/108 |
| 1,703,284 | 2/1929 | Wolfe | 222/108 |
| 2,144,004 | 1/1939 | Wilson | 222/108 X |
| 2,991,912 | 7/1961 | Thomas et al. | 222/108 X |
| 3,204,830 | 9/1965 | Harr | 222/108 X |
| 4,865,225 | 9/1989 | Chavez et al. | 222/108 |
| 5,339,676 | 8/1994 | Johnson | 141/86 X |
| 5,390,714 | 2/1995 | North, III et al. | 144/88 X |
| 5,470,011 | 11/1995 | Jordan | 222/108 |

*Primary Examiner*—Kenneth Bomberg
*Attorney, Agent, or Firm*—Stephen R. Greiner

[57] ABSTRACT

A drip collecting device for use with a beverage dispenser having a spigot. The drip collecting device includes a plate for supporting the beverage dispenser. A bracket is secured to the plate and extends downwardly therefrom. The bracket has at least two vertically spaced slots formed in it. A cup, having a stud extending from one of its sides, may be secured to the bracket beneath the spigot of the beverage dispenser to collect drips. The height of the cup may be varied by selectively inserting the stud into either of the vertically spaced slots in the bracket.

10 Claims, 2 Drawing Sheets

ADJUSTABLE AND COLLAPSIBLE DRIP COLLECTION DEVICE

FIELD OF THE INVENTION

The present invention relates generally to dispensers and, more particularly, to drip, leakage or waste catching devices therefor.

BACKGROUND OF THE INVENTION

Devices for collecting the beverage inadvertently dripped from the spigot of a dispenser are widely known. These devices typically include a collection reservoir suspended beneath the spigot outlet at a distance which is greater than the height of a drinking vessel so that the drinking vessel may be conveniently placed in the beverage dispensing position. Since the distance from the spigot outlet to the top of the collection reservoir is usually fixed, taller than average drinking vessels cannot be easily accommodated by a typical drip collecting device. On the other hand, when shorter than average drinking vessels are employed with such a device, excessive splashing of beverage dripped into the collection reservoir can result in the unintended loss of liquid from the collection reservoir thereby reducing the effectiveness of the device.

SUMMARY OF THE INVENTION

In light of the problems associated with the prior art, it is a principal object of the invention to a drip collecting device which may be used in conjunction with beverage dispensers and drinking vessels having a variety of sizes in such a manner that drips may be reliably collected.

It is another object of the invention to provide a drip collecting device which may easily disassembled for washing and subsequent storage in a collapsed and compact condition.

It is an object of the invention to provide improved elements and arrangements thereof in a drip collecting device for the purposes described which is lightweight in construction, inexpensive in manufacture, and fully effective in use.

Briefly, the drip collecting device in accordance with this invention achieves the intended objects by featuring a plate for supporting a conventional beverage dispenser having a spigot. A bracket is secured to the plate and extends downwardly therefrom. The bracket has two or more vertically spaced slots formed therein. A cup, having a stud extending from one of its sides, may be secured to the bracket beneath the spigot of the beverage dispenser to collect drips. The stud is dimensioned for selective insertion into, and retention by, either of the vertically spaced slots in the bracket thus allowing the height of the cup to be varied in accordance with need.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
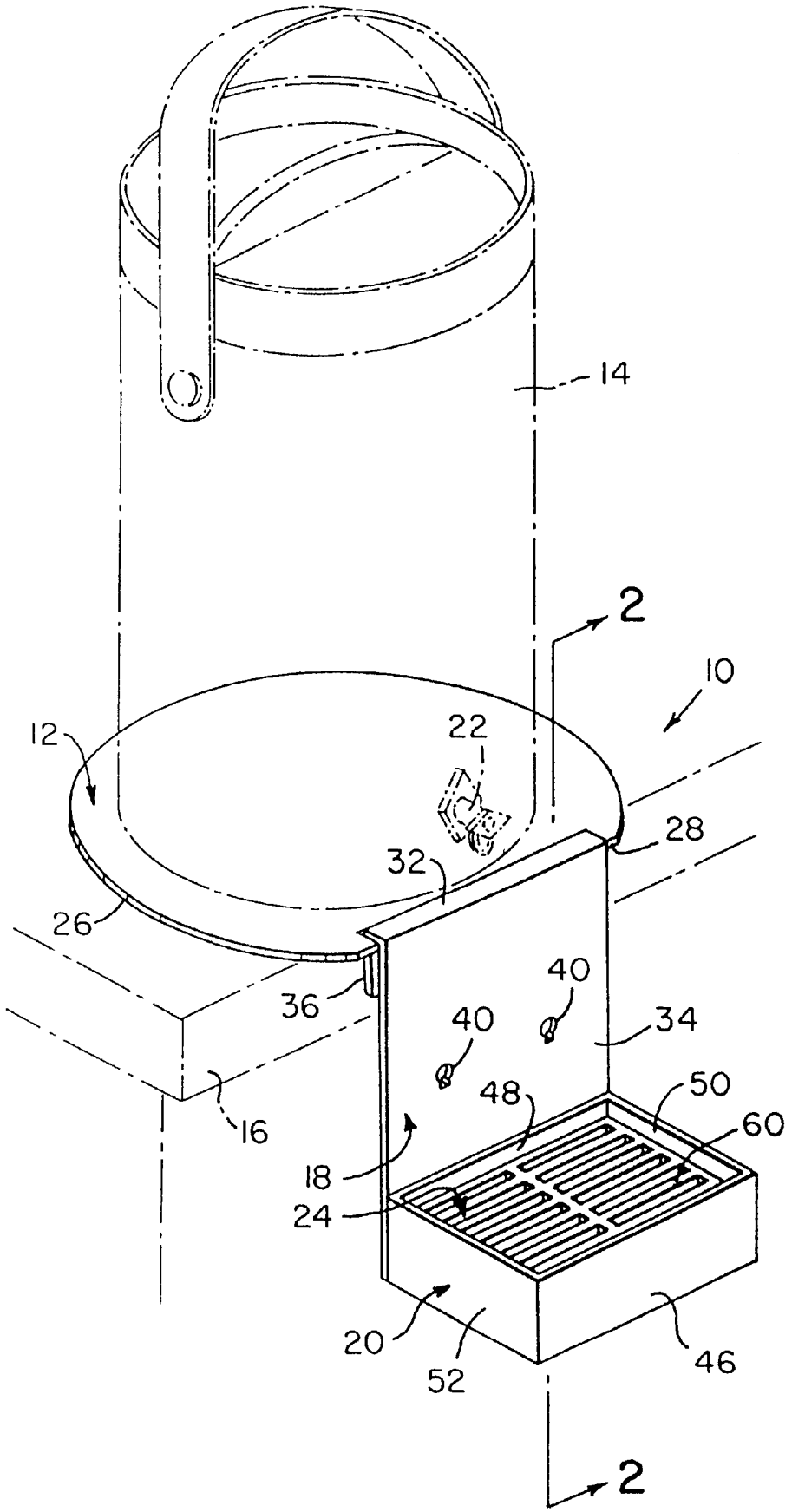
FIG. 1 is a front perspective view of a beverage dispenser with an adjustable and collapsible drip collecting device in accordance with the present invention.
Figure 2:
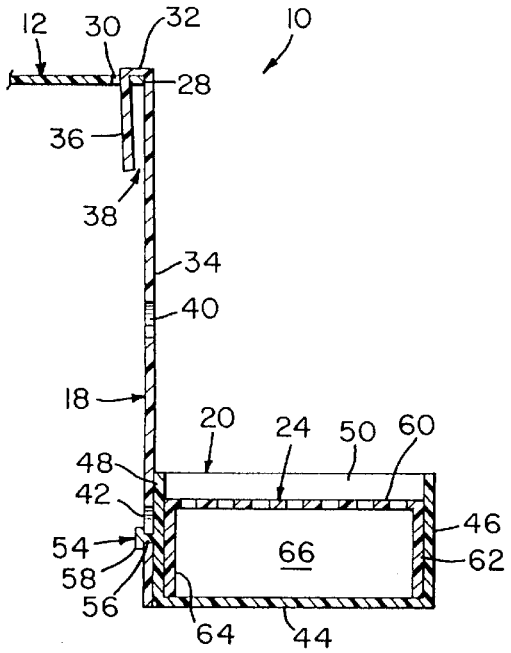
FIG. 2 is a cross-sectional view taken along line 2—2 of FIG. 1.
Figure 3:
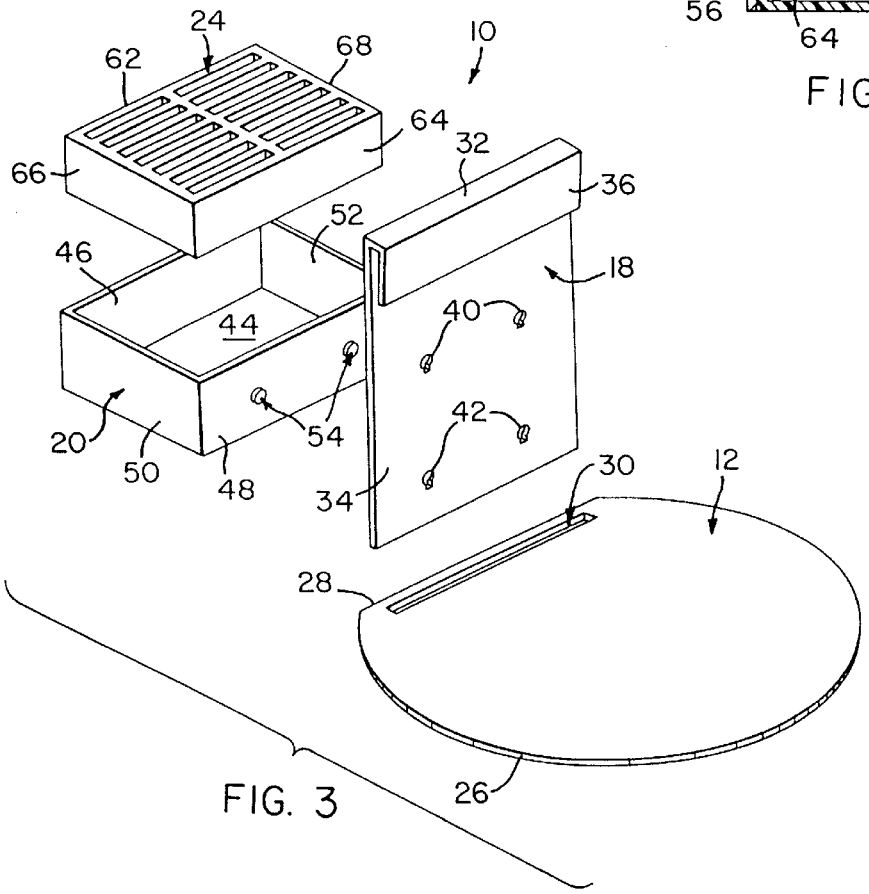
FIG. 3 is a rear perspective and exploded view of our adjustable and collapsible drip collecting device.

Referring now to the FIGS., an adjustable and collapsible drip collecting device in accordance with the present invention is shown at 10. The device 10 includes an impermeable plate 12 for isolating a beverage dispenser 14 from the top of a supporting table 16 or like surface. A bracket 18 is suspended from one portion of the plate 12 so that it can hang over the side of the table 16. Secured to the bracket 18 is a repositionable cup 20 for collecting liquids dripped from the spigot 22 of the dispenser 14. A grate 24, positioned within the cup 20, isolates a user from any collected liquids.

The plate 12 may be provided with any desired outline. Nonetheless, since many beverage dispensers, like the one at 14, are circular at their bottom ends, the plate 12 has that general shape. As shown, the plate 12 includes a peripheral edge that is circular along one portion 26 of its length and is flat along another portion 28. Preferably, the flat portion 28 has a length approximately equal to the radius of curvature of the circular portion 26.

The plate 12 is provided with an elongated slot 30 closely adjacent to the flat portion 28. The longitudinal axis of the slot 30 is oriented parallel to the flat portion 28. The length of the slot 30, however, is preferably somewhat less than that of the flat portion 28 so that the slot 30 may be defined by four sides.

The bracket 18 includes three rectangular members 32, 34 and 36, each having a width substantially equal to that of the slot 30, secured end-to-end so as to form a hook. The intermediate member 32 defines the top of the hook and is adapted to snugly engage the top of the plate 12 between the flat portion 28 and slot 30. The front member 34, on the other hand, defines the shank of the hook and extends downwardly at a right angle from the forward edge of the intermediate member 32. The rear member 36, constituting the hook's retainer, extends downwardly from the rearward edge of the intermediate member 32 and is adapted to extend a short distance through the slot 30. Preferably, the rear member 36 slopes toward the front member 34 to provide a narrow opening 38 between the front and rear members 34 and 36 which aids in retaining the bracket 18 on the plate 12 during use.

The front member 34 of the bracket 18 is provided with two vertically-spaced pairs of key-hole slots 40 and 42. As illustrated in the FIGS., each of the key-hole slots 40 and 42 has a circular upper portion with a rectangular notch extending downwardly therefrom. Each notch preferably has a length and width measuring less than that of the radius of its associated circular upper portion.

The repositionable cup 20 includes a rectangular bottom wall 44 as well as a front wall 46, a back wall 48, and a pair of opposed side walls 50 and 52 extending vertically upward from the bottom wall 44. The bottom, front and back walls 44, 46 and 48 preferably have a width equal to that of the front member 34 of the bracket 18 for optimum stability. The other dimensions of the cup 20 may be varied to suit a user's needs.

Extending rearwardly from the back wall 48 of the cup 20 are a pair of studs 54 adapted for selective insertion into either of the key-hole slots 40 or 42. Each of the studs 54 includes a narrow stem 56 for snug positioning in a notch at the base of one of the key-hole slots 40 or 42. At the terminal end of the stem 56 is an enlarged head 58 for retaining the stem 56 within a slot 40 or 42.

The top of the grate 24 includes a framework of latticed bars 60 defining a plurality of openings for the passage of liquids toward the bottom of the cup 20. The latticed bars 60 are supported at a predetermined height above the bottom of the cup 20 by downwardly extending legs 62, 64, 66 and 68. The legs 62, 64, 66 and 68 are adapted to fit snugly against the walls 46, 48, 50 and 52 of the cup 20 to prevent the undesired discharge of the grate 24 from the cup 20 when the cup 20 is tipped to drain collected liquids therefrom.

The plate 12, bracket 18, cup 20 and grate 24 are each preferably molded from a thermoplastic material known for its durability and imperviousness to beverages. In the alternative, the various components of the device 10 may be constructed from metal, paper, wood or any other suitable material. Of course, the components can be made in a variety of sizes to accommodate beverage dispensers of different dimensions and capacities.

Use of the device 10 is straightforward. First, the device 10 is assembled by: 1) positioning the grate 24 within the cup 20, 2) inserting the studs 54 on the cup 20 into either pair of key-hole slots 40 or 42, 3) settling the stems 56 of the studs 54 into the notches of the slots 40 or 42, and 4) extending the rear member 36 of the bracket 18 into the elongated slot 30 in the plate 12. Next, the plate 12 is positioned on a support such as table 16 with the bracket 18 and cup 20 suspended over the side of the support. Then, the plate 12 is anchored in position by placing the beverage dispenser 14 on top of the plate 12 with its spigot 22 aligned over the cup 20. Should the cup 20 become filled with liquid dripped from the spigot 22, the cup 20 may be easily removed from the bracket 18, drained and replaced.

After use, the device 10 can be disassembled by reversing the steps noted above. The separated plate 12, bracket 18, cup 20 and grate 24 may then be thoroughly washed in soap and water. Once washing has been completed, the separated components of the device may be gathered into a small volume and stored for subsequent use.

While the invention has been described with a high degree of particularity, it will be appreciated by those skilled in the art that numerous modifications and substitutions may be made thereto. Therefore, it is to be understood that the present invention is not limited to the sole embodiment described above, but encompasses any and all embodiments within the scope of the following claims.

We claim:

1. A drip collecting device for use with a beverage dispenser having a spigot, said drip collecting device comprising:

a plate adapted to support a beverage dispenser;

a bracket secured to said plate and extending downwardly therefrom, said bracket having at least two vertically spaced slots formed therein; and, a cup adapted to be positioned beneath a spigot of a beverage dispenser to collect drips therefrom, said cup having a stud extending from one side thereof, said stud being dimensioned for selective insertion into, and retention by, either of said vertically spaced slots in said bracket.

2. The drip collecting device according to claim 1 wherein:

each of said vertically spaced slots has a wide upper portion and a relatively narrow lower portion extending downwardly therefrom; and, said stud includes an enlarged head supported at the terminal end of a relatively narrow stem adapted for snug positioning within said lower portion of either of said vertically spaced slots.

3. The drip collecting device according to claim 1 further comprising a grate positioned within said cup, said grate including a framework of latticed bars and a plurality of legs secured to said framework of latticed bars for engaging the bottom of said cup and supporting said framework of latticed bars at a predetermined height above the bottom of said cup.

4. The drip collecting device according to claim 1 wherein:

said plate has a peripheral edge and is provided with an elongated slot adjacent said peripheral edge; and, said bracket has a hook at its upper end adapted to engage said elongated slot and selectively secure said bracket to said plate.

5. A drip collecting device for use with a beverage dispenser having a spigot, said drip collecting device comprising:

a plate adapted to support a beverage dispenser, said plate having a flat edge portion and an elongated slot adjacent said flat edge portion;

a bracket having a hook at its upper end adapted extend over said flat edge portion and engage said elongated slot so as to selectively secure said bracket to said plate, said bracket having at least two pairs of vertically spaced slots remote from said hook; and, a cup adapted for positioning beneath a spigot of a beverage dispenser to collect drips therefrom, said cup having a pair of studs extending from one side thereof, said studs being adapted for selective insertion into, and retention by, either of said pairs of vertically spaced slots in said bracket.

6. The drip collecting device according to claim 5 wherein:

each of said vertically spaced slots has a wide upper portion and a relatively narrow lower portion extending downwardly therefrom; and, each of said studs includes an enlarged head supported at the terminal end of a relatively narrow stem adapted for snug positioning within said lower portion of one of said vertically spaced slots.

7. The drip collecting device according to claim 5 further comprising a grate positioned within said cup, said grate including a framework of latticed bars and a plurality of legs secured to said framework of latticed bars for engaging the bottom of said cup and supporting said framework of latticed bars at a predetermined height above the bottom of said cup.

8. The drip collecting device according to claim 5 wherein said plate, bracket and cup are each molded from a thermoplastic material.

9. A drip collecting device for use with a beverage dispenser having a spigot, said drip collecting device comprising:

a plate for supporting the beverage dispenser, said plate having a flat edge portion and an elongated slot adjacent said flat edge portion;

a bracket for selective attachment to said plate, said bracket including:

an intermediate member for engaging the top of said plate between said flat edge portion and said elongated slot, said intermediate member having spaced-apart front and rear edges;

a front member extending downwardly from said front edge of said intermediate member, said front member having at least two pairs of vertically-spaced, key-hole slots; and, a rear member extending downwardly from said rear edge of said intermediate member, said rear member adapted for selective positioning within said elongated slot in said plate; and, a cup for positioning beneath the spigot of the beverage dispenser to collect drips therefrom, said cup having a pair of studs extending from one side thereof adapted for selective positioning within one pair of said key-hole slots, each of said studs including an enlarged head supported at the terminal end of a relatively narrow stem adapted for snug positioning within said lower portion of one of said key-hole slots.

10. The drip collecting device according to claim 9 further comprising a grate positioned within said cup, said grate including a framework of latticed bars, for isolating a user from liquids collected within said cup, and a plurality of legs secured to said framework of latticed bars for engaging the bottom of said cup and supporting said framework of latticed bars at a predetermined height above the bottom of said cup.

* * * * *